United States Patent [19]

Parker et al.

[11] Patent Number: 4,720,892

[45] Date of Patent: Jan. 26, 1988

[54] BRUSH ROLLER ATTACHMENT REPAIR KIT MEMBER AND METHOD OF REPAIRING A VACUUM CLEANER

[76] Inventors: Winfred C. Parker; Randy L. Parker, both of 6220 Commodore La., Oklahoma City, Okla. 73132

[21] Appl. No.: 12,390

[22] Filed: Feb. 9, 1987

Related U.S. Application Data

[62] Division of Ser. No. 789,736, Oct. 21, 1985, Pat. No. 4,662,027.

[51] Int. Cl.[4] ..... A47L 9/08

[52] U.S. Cl. ..... 15/392; 29/402.08

[58] Field of Search ..... 15/392, 257 A; 29/402.08

[56] References Cited

U.S. PATENT DOCUMENTS

| | | | |
|---|---|---|---|
| 1,783,205 | 12/1930 | White | 15/392 |
| 2,192,397 | 3/1940 | Carlson | 15/392 X |
| 2,244,943 | 6/1941 | Dow | 15/392 |
| 2,317,570 | 4/1943 | White | 15/392 |
| 2,614,823 | 10/1952 | Thornwald | 15/392 X |
| 2,668,979 | 2/1954 | MacFarland | 15/392 X |
| 3,802,026 | 4/1974 | Grener | 15/392 X |

*Primary Examiner*—Chris K. Moore

*Attorney, Agent, or Firm*—Dunlap, Codding & Peterson

[57] ABSTRACT

The invention concerns a repair kit for vacuum cleaners, and a method of repairing a vacuum cleaner, in which a vacuum cleaner housing with a worn or damaged keyway for a keying member on a brush roller is reconditioned by removing the portion of the housing with a worn keyway and substituting a U-shaped member which provides a new keyway as well as retaining slots for spring detent members. The cap member of the brush roller is provided with a keying member as well as a spring member with spring detent members.

3 Claims, 7 Drawing Figures

BRUSH ROLLER ATTACHMENT REPAIR KIT MEMBER AND METHOD OF REPAIRING A VACUUM CLEANER

This application is a division, of application Ser. No. 789,736 filed Oct. 21, 1985, now U.S. Pat. No. 4,662,027, issued May 5, 1987, and entitled brush roller attachment kit.

FIELD OF THE INVENTION

This invention relates to mounting of a brush roller in a vacuum cleaner housing, and more particularly, to a self contained brush roller mounting assembly which can be releasably attached to the frame of a vacuum cleaner housing and provide for releasable retention and keyed alignment of a brush roller relative to a vacuum cleaner housing.

BACKGROUND OF THE INVENTION

Floor or rug type vacuum cleaners generally include an integrally formed housing constructed of cast metal or molded plastic principally to enclose and mount a drive motor which rotates a horizontally disposed brush roller in the housing by a belt drive. A typical brush roller includes a tubular roller member with outer segments of brush spirally attached to the roller member. The brush roller has a centrally located annular groove for a belt connection and is rotatably mounted relative to a central shaft member and end caps. The end caps are threadedly attached to the central shaft member and one end cap has a projecting key member which is slidably received in a key slot in the vacuum cleaner housing.

Manufacturers of vacuum cleaners generally construct the housing so that the key slot for the key member of a brush roller is formed as part of the housing in the casting or molding process. While this is desirable from a manufacturing point of view, the consumer or user of the vacuum cleaner eventually must deal with the problem of a distorted or damaged key slot in a housing. The problem occurs because of use and becomes self evident to the consumer or user. The only solutions to the problem are to replace the housing or to buy a new machine, both of which are substantially more expensive than the nature of the problem.

The present invention provides a third alternative to the consumer in the form of a relatively inexpensive repair kit which can be used by a repair service outlet or consumer. Should the manufacturer desire, the kit could be installed as original equipment.

STATEMENT OF THE INVENTION

The present invention is constituted by a U-shaped support or attachment member which is releasably attached to the housing frame of a vacuum cleaner at an appropriate location for mounting of a brush roller. When attached, the support member is essentially integral with the vacuum housing and provides a central and vertical key slot with an open bottom end and a closed top end. On either side of the key slot, the support member has rectangular vertical openings or slots for receiving resilient means in the form of a spring clip attached to a cylindrically formed end cap on a brush roller.

One cylindrical end cap on a brush roller has a central, outwardly extending or projecting key member with keying surfaces sized to be slidably received in a key slot of a support member. Also on the same end cap is a spring plate member constructed of spring material, the spring plate member having a central elongated opening which is non-rotatably received by a key member. When the spring plate member is located on an end cap, locking fingers on the plate member engage locking slots in a key member for affixing the plate member to the end surface of the end cap. The plate member also has projecting spring arms in the form of spring clips which flexibly apply a spring force between the vacuum cleaner housing and the end cap to assist in holding the brush roller in the desired position in the housing.

DESCRIPTION OF THE DRAWINGS

The accompanying drawing is illustrative of the present invention in which.

DESCRIPTION OF THE INVENTION

Figure 1:
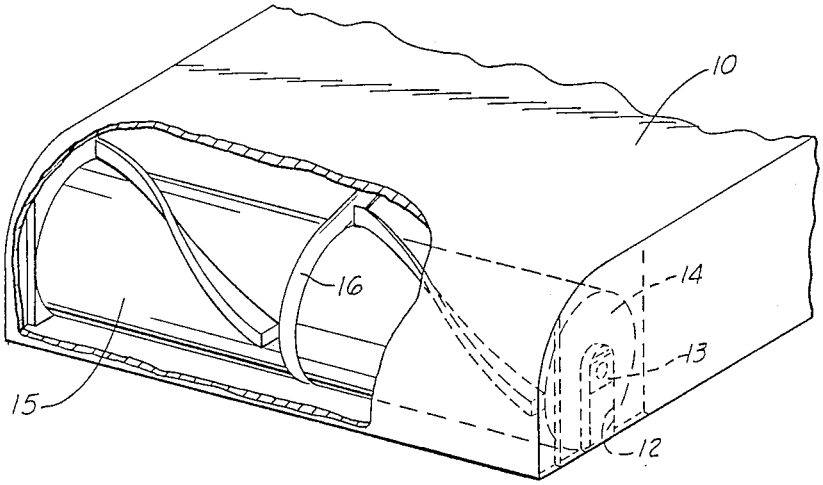
FIG. 1 PRIOR ART
FIG. 1. is a perspective view of the present state of the art of a vacuum cleaner housing with an integrally formed key slot.

Referring first to FIG. 1 for background purposes, a vacuum cleaner housing 10 is illustrated with an internal, vertical key slot 12 disposed on one side of the housing The key slot 12 is formed as an integral part of the housing. A key member 13 on an end cap 14 is attached to a brush roller 15 and slidably received in the key slot 12. A locking plate mechanism (not shown) is attached to the housing to retain the key member in the key slot. A belt 16 provides a drive from a motor to a central portion of the brush roller 15.

In the present invention, when an integrally formed key slot in the housing becomes worn and unusable for its intended function, the first step in the repair operation is to remove the brush roller 15. To utilize the same length of brush roller 15, the housing 10 is modified by grinding or otherwise removing an internal projection (not shown) on the housing in which the integral key slot 12 is formed. A portion of the bottom surface 19 of the housing may be notched (shown by the number 20, in FIG. 2) by grinding or other means to accommodate the width of a support member or U-shaped attachment 21.

Figure 6:
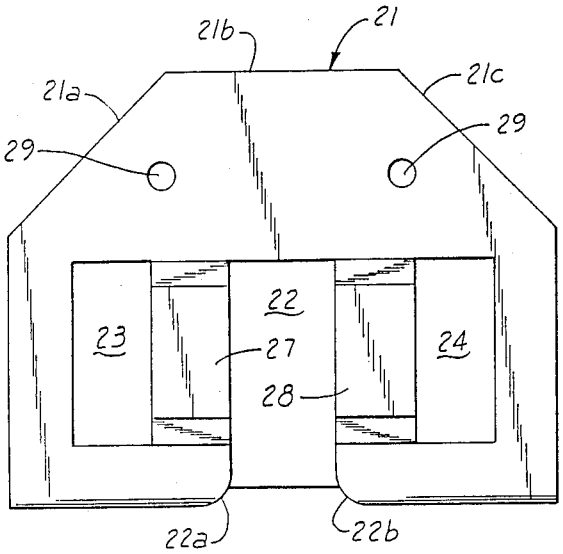
FIG. 6 is an end view of an attachment plate member.
Figure 7:
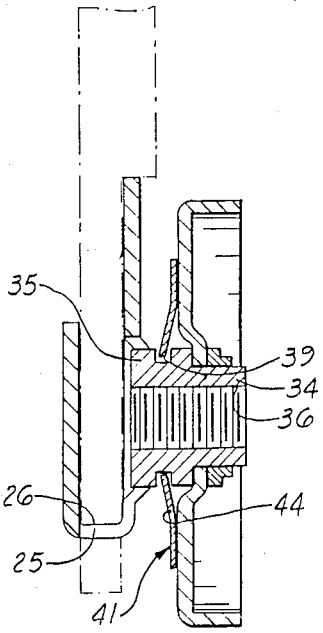
FIG. 7 is a view in vertical cross-section through the assembly of the present invention as installed on the housing of a vacuum cleaner.

The U-shaped attachment support member 21 provides a substitute key slot. The support member 21 is formed from a flat piece of stock metal in which a center, generally rectangular, opening 22 and side rectangular openings 23 and 24 (see FIGS. 2 and 6) can be provided, as by a punching operation. The center opening 22 is preferably rounded at the bottom end to provide ease of installation of a key member as will be described. While the upper end surfaces of the openings 22–24 are in general horizontal alignment, the center opening 22 has a greater length so that upon forming a plate member to a U-shape, the bottom surface 25 of the opening is located below the bottom surface 26 (see FIG. 3) of the vacuum cleaner housing and thus leaves an open keyway slot or space between the slightly rounded side surfaces 22*a* and 22*b* for receiving a key member. Additionally, the connecting strips 27 and 28 on a support member 21 which are located between the openings 22, 23 and between the openings 22, 24 are permanently elongated to project outwardly from a flat surface of the plate member 21 so as to enhance the holding strength of a key way slot. Further, the central portions 27*a* and 28*a* of the strips 27 and 28 are preferably flat. A pair of bolt openings 29 are extended through the plate member 21 and through the side wall of the housing to receive a nut and bolt interconnecting means (not shown). The upper, inner edges 21*a*, 21*b* and 21*c* of the member 21 are shaped to engage the lower ends of stops 10*a*, 10*b* and 10*c* normally formed on the inner surface of the housing 10 when the housing is made of a plastic material. Thus, the support member 21 is attachable to the housing frame and provides a stable and integrally attached central keyway slot which is formed by the opening 22. The side openings or slots 23 and 24 are provided for receiving resilient means on an end cap member as will be explained later.

Figure 2:
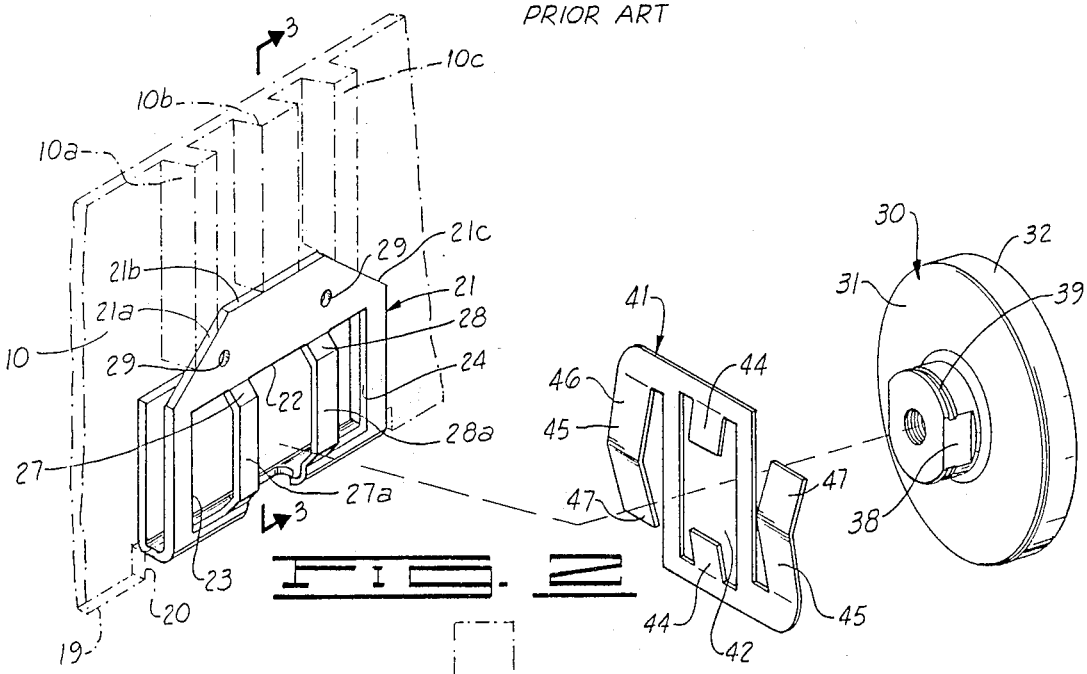
FIG. 2 is a view in perspective of an attachment support member, a spring plate member and an end cap incorporating the features of the present invention.
Figure 3:
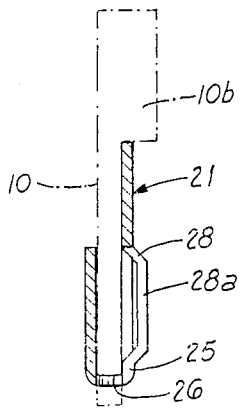
FIG. 3 is a view taken along line 3—3 of FIG. 2.
Figure 4:
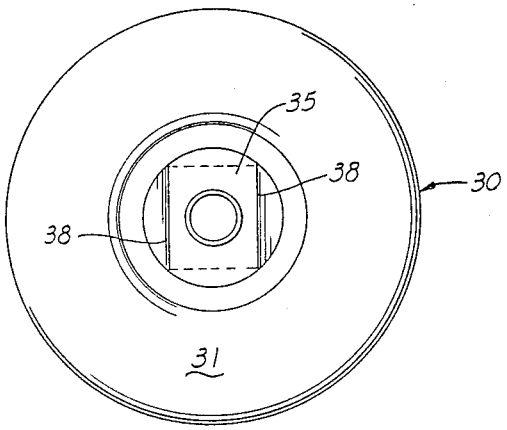
FIG. 4 is an end view of an end cap member.

A cylindrically shaped end cap member 30 for a brush roller, as shown in FIGS. 2 and 4, has a forward flat surface 31 perpendicular to the central axis of the cap member and an annular flange 32 which rotatably receives the end of a cylindrically shaped brush roller. A central section of the cap member 30 is provided with a circular walled recess and a central opening for receiving a cylindrically shaped and threaded mounting pin 34 on a key member 35. A connecting means on the interior of the cap member attaches to the threaded mounting pin 34 to secure the key member 35 to the cap member 30. The key member 35 has a centrally located threaded bore 36 which has its central axis aligned with the central axis of the cap member A connecting rod (not shown) with threaded ends is connected to the end cap member 30 by the threaded connection to the key member 35 and also provides internal rotational support (not shown) for the tubular brush roller.

The key member 35 on the end cap member has parallel side keying surfaces 38 to either side of the central axis of the key member which project outwardly from the end cap member. The side keying surfaces 38 are spaced apart and extended outwardly from the end cap member to be slidably and non-rotatively received in the opening 22 in the attachment support member 21. The upper and lower horizontally disposed surfaces of the key member 35 have transverse notches or locking grooves 39 located perpendicular to the vertical sidn surfaces 38 for receiving locking fingers 44 on a spring plate member 41.

Figure 5:
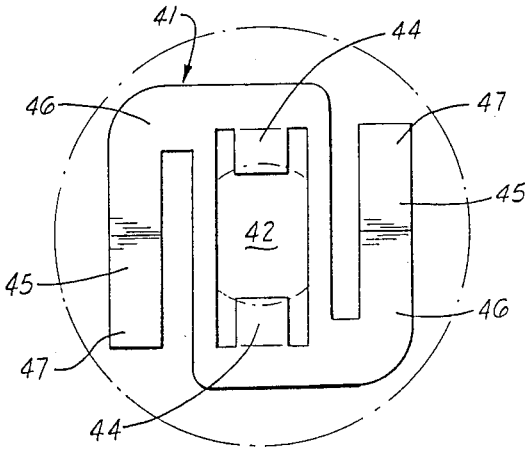
FIG. 5 is an end view of a spring plate member.

The spring plate member 41, as shown in FIGS. 2 and 5 is constructed from spring material and has a generally flat surface with a central, rectangularly shaped or elongated opening 42 where the vertical side surfaces of the opening 42 slidably receive the side surfaces 38 of the key member 35. The upper and lower transverse surfaces of the opening 42 respectively have inwardly extending locking fingers 44. The fingers 44 extend inwardly so that the ends of the fingers engage the transverse grooves 39 in the key member and are flexed outwardly from the flat surface of the plate member. When the plate member 41 is inserted over the key member 35, the ends of the fingers 44 are sized to engage the transverse slots 39 and resiliently bias the plate member 41 against the vertical end surface 31 of the cap member 30.

On either side of the opening 42, the plate member 41 has spring elements 45 which are flat surfaces bent between a connected end at 46 and a free end at 47 which engages the surface of an end cap member. The spring elements 45 are disposed so as to be received into the slots 23 and 24 in the attachment member 21 and so as to be compressed by engagement with the wall of the cleaner housing thereby to center and resiliently retain the end cap members (and hence the brush roller) in the housing of a vacuum cleaner.

While the construction and operation is believed to be apparent, in summary, the existing integral key slots in a vacuum cleaner housing are removed so that a U-shaped attachment support plate member 21 can be affixed to the housing by nuts and bolts. One end cap member 30 has an attached key member 35 and the spring plate member is attached to the end cap member by spring fingers which engage the grooves 39 in the key member. Next, the cap member 30 is attached to a brush roller cylinder and the unit inserted into the housing frame by vertically aligning the surfaces 38 of the key member with the keying surfaces in the vertical opening 22 and sliding the unit into position so that the spring elements 45 are snapped into position in the recesses 23 and 24 and assist in holding the brush roller in position. It should also be noted that the attachment support plate will reinforce the adjacent wall of the vacuum cleaner housing, which is particularly helpful when the housing is formed of a plastic material.

While the foregoing description has been related to repair kits for existing vacuum cleaners, it is also possible for a manufacturer to incorporate the kit as a part of the original equipment so that when a key slot wears, it is a simple and inexpensive operation for repair.

While only selected embodiments of the present invention are illustrated and described herein, other embodiments of the invention are contemplated and many changes and modifications of the invention may be made within the scope of the appended claims without departing from the spirit of the invention.

What is claimed is:

1. A subcombination for use in a repair kit for vacuum cleaners for replacement of a worn key slot in a vacuum cleaner housing comprising:

a U-shaped attachment plate member having a central elongated opening in a lengthwise direction of the plate member sized to a key slot dimension and having elongated slots to either side of said central elongated opening disposed between the upper end of the plate member and the U-shaped bend in the plate member where said central elongated opening extends through the U-shaped bend in the attachment plate member.

2. A method of repairing a vacuum cleaner housing having an integrally formed first projecting portion in the housing which defines a key slot for a key member on a brush roller where the key slot has become worn, comprising the steps of:

removing the first projecting portion of the thickness of a vacuum cleaner housing which defines a key slot to remove the portion of the housing defining the key slot and to leave inner and outer vertical wall surfaces;

removing a portion of the bottom surface of the vacuum cleaner housing adjacent to said first projecting portion to provide a notch in the bottom surface of a vacuum cleaner housing;

forming a U-shaped attachment plate member with a central elongated opening sized to the key slot to be replaced and with side elongated openings where said central elongated opening extends through the bend in the U-shaped attachment plate member;

attaching said attachment plate member to the vacuum cleaner housing so that the inner wall of said attachment plate member has the central elongated opening aligned to the previous location of the integrally formed key slot in the housing and the bend in the attachment plate member fits into said notch;

attaching a keying member to a cylindrically shaped end cap member for a brush roller where the keying member has parallel keying surfaces to either side of a central axis sized for a keying relationship to said central elongated opening and has locking grooves; and attaching a spring plate member to the end cap member where the spring plate member has an elongated opening to be slidably but non-rotatively received by the keying surfaces and to engage the end surface of the end cap member, said spring plate member having locking fingers for engaging the locking grooves for retaining the spring plate member on the end cap member, said spring plate member having projecting spring detent members to either side of the elongated opening in the spring plate member so that upon assembly, said keying surfaces are nonrotatively received in a key slot and said spring detent members are received in said side openings.

3. A subcombination for use in a repair kit for a vacuum cleaner for replacement of a worn slot in a vacuum cleaner housing, the vacuum cleaner having a cap member for a cylindrically shaped brush roller, a keying member attached to the cap member so as to project outwardly from the cap member, and a plate member adapted to engage the cap member having an opening for receiving the key member and spring detent projections, the subcombination comprising:

a U-shaped housing plate member adapted to engage the inner and outer surfaces of a vacuum cleaner housing and to be attachable to the vacuum cleaner housing, said housing plate member having a U-shaped key slot in a vertical direction with an open bottom end when attached to a vacuum cleaner housing, said housing plate member having spaced apart slot openings disposed to either side of said U-shaped key slot, said slot openings being sized and arranged to receive said spring detent projections.

* * * * *